US007375629B1

(12) United States Patent
Moyer

(10) Patent No.: US 7,375,629 B1
(45) Date of Patent: May 20, 2008

(54) CLOSE PROXIMITY ALERT SYSTEM AND METHOD

(75) Inventor: Dale Eldon Moyer, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 172 days.

(21) Appl. No.: 11/398,203

(22) Filed: Apr. 4, 2006

(51) Int. Cl.
*G08B 1/08* (2006.01)

(52) U.S. Cl. ..... 340/539.13; 340/573.4; 340/825.49; 342/357.08; 342/357.09

(58) Field of Classification Search ..... 340/539.13, 340/572.4, 825.49, 573.4; 342/357.08, 357.09
See application file for complete search history.

(56) References Cited

U.S. PATENT DOCUMENTS 5,461,390 A * 10/1995 Hoshen ..... 342/419
5,652,569 A 7/1997 Gerstenbeger et al.
5,867,103 A * 2/1999 Taylor, Jr. ..... 340/573.4
5,982,281 A * 11/1999 Layson, Jr. ..... 340/539.13
6,396,403 B1 5/2002 Haner
6,747,555 B2 6/2004 Fellenstein et al.
6,774,797 B2 * 8/2004 Freathy et al. ..... 340/573.1
6,838,998 B1 * 1/2005 Brown et al. ..... 340/825.49
6,847,295 B1 1/2005 Taliaferro et al.
6,864,789 B2 * 3/2005 Wolfe ..... 340/539.1
6,998,985 B2 * 2/2006 Reisman et al. ..... 340/573.1
2004/0185895 A1 9/2004 Aisenberg
2005/0086261 A1 4/2005 Mammone
2005/0143099 A1 6/2005 Piccioni
2005/0149561 A1 7/2005 Hodnett et al.

* cited by examiner

*Primary Examiner*—Davetta W. Goins
*Assistant Examiner*—Anne V. Lai

(57) ABSTRACT

A method for tracking location of a first class of user and a second class of user includes determining a location of a first class of user, updating a first class of user location database with the location of the first class of user, determining a location of a second class of user, updating a second class of user location database with the location of the second class of user, comparing location of the first class of user with the location of the second class of user, determining whether predetermined criteria related to the location of the first class of user with the location of the second class of user is met, and initiating a communication to one or more entities if the predetermined criteria is met.

15 Claims, 4 Drawing Sheets

CLOSE PROXIMITY ALERT SYSTEM AND METHOD

FIELD OF THE INVENTION

The present invention relates, in general, to location tracking systems and methods for tracking the location of moving objects, and, in particular, to location tracking systems and methods for tracking the location of sex offenders and sexual predators.

BACKGROUND OF THE INVENTION

Today more and more devices are capable of reporting their position. As a result of the FCC's E911 mandate for wireless phones, all cellular networks must be capable of reporting the position of the caller. Many CDMA carriers have implemented handset based solutions employing GPS (or A-GPS and AFLT), where the measurements used to determine position are done at the handset. Some carriers have chosen to use network-based solutions where the measurements done to locate the handset are done by the network. As a result of the FCC E911 mandate, location information for cellular handsets can be readily available and used for a variety of location-based services. Cell phones have become integral with our society so much so that now it is becoming more and more common for children to carry cell phones. Location-based services with children's safety in mind have been implemented. In some solutions, for example, parents can determine where their child is and which direction they might be headed.

The justice system is making use of GPS transponders to track criminals. It is becoming common today that criminals, such as sex offenders and sexual predators, must wear such a device as a condition of their release. These transponders are monitored to make sure that the criminal does not go to locations that are prohibited. For example a sex predator may not be allowed within a certain distance of a school or playground.

A problem with these systems for tracking sex offenders and sexual predators is that there is no way of knowing if the offender is in the presence of a child. Protection of children is further complicated since, according to the Child Safety Network (CSN), identification of children in an emergency is difficult because they are not required to carry identification. Moreover, many young children are not capable of dialing their home number if they are outside of their area code.

SUMMARY OF THE INVENTION

Aspects of the present invention involve systems and methods for determining whether the location of a first class of user (e.g., child) meets certain predefined criteria when compared to the location of a second class of user (e.g., sex offender, sexual predator), and causing an appropriate action to occur if the predefined criteria is met. Location of two different classes of users are updated in one or more location databases periodically (near real time). The dynamically changing location database of the first class of users is compared to the dynamically changing location database of the second class of users. When the location of a member of the first class of users matches certain criteria when compared to the location of a member of the second class, a notification is generated. The notification could be for the member of the first class, the member of the second class, and/or for a third party. The notification to the different entities could be the same or different. The notification can start a sequence of events that might include additional monitoring to determine if a second set of criteria is met, prompting an action.

According to one embodiment, a method for tracking the location of a first class of user and a second class of user includes determining a location of a first class of user, updating a first class of user location database with the location of the first class of user, determining a location of a second class of user, updating a second class of user location database with the location of the second class of user, comparing location of the first class of user with the location of the second class of user, determining whether predetermined criteria related to the location of the first class of user with the location of the second class of user is met, and initiating a communication to one or more entities if the predetermined criteria is met.

According to another embodiment, a system for tracking the location of a first class of user and a second class of user includes a wireless communication device carried by the first class of user, the wireless communication device including a location identification mechanism, a location identification mechanism carried by the second class of user, one or more servers including one or more modules to: determine a location of a first class of user, update a first class of user location database with the location of the first class of user, determine a location of a second class of user, update a second class of user location database with the location of the second class of user, compare location of the first class of user with the location of the second class of user, determine whether predetermined criteria related to the location of the first class of user with the location of the second class of user is met, and initiate a communication to one or more entities if the predetermined criteria related to the location of the first class of user is met.

According to another embodiment, a method for tracking a sex offender with respect to a child includes receiving location information on the child, receiving location information on the sex offender, comparing location information of the child with the location information of the sex offender, determining whether predetermined criteria related to the location information of the child with the location information of the sex offender is met, and initiating a communication to one or more entities if the predetermined criteria is met.

According to another embodiment, a computer-implemented system for tracking a sex offender with respect to a child includes one or more servers with one or more modules to: receive location information on the child, receive location information on the sex offender, compare location information of the child with the location of the sex offender, determine whether predetermined criteria related to the location information of the child with the location information of the sex offender is met, and initiate a communication to one or more entities if the predetermined criteria is met.

According to another embodiment, a wireless communication device configured to be communicatively coupled to a wireless network includes an antenna system configured to send and receive signals over a wireless physical medium, a radio system configured to manage the antenna system for use with a radio access technology to provide connection to the wireless network, a location identification mechanism for obtaining and providing location information on the wireless communication device, a central processing unit configured to execute instructions stored in a data storage area and access data stored in a data storage area, a panic module executable by the central processing unit, the panic module configured to put the wireless communication device in a quasi-operative mode that appears to be off to the user and to communicate with an operator, an operator-control module executable by the central processing unit, the operator-control module configured to allow the operator to maintain control of the communication with the wireless communication device and control one or more functions on the wireless communication device, an auto-answer module executable by the central processing unit, the auto-answer module configured to automatically accept an incoming call that is not answered manually, and a power-down module executable by the central processing unit, the power-down module configured to cause the handset to appear to power-down upon actuation of a power-down sequence while continuing to operate.

DETAILED DESCRIPTION

Certain embodiments as disclosed herein provide for systems and methods for determining whether the location of a first class of user meets certain predefined criteria when compared to the location of a second class of user, and taking appropriate action.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
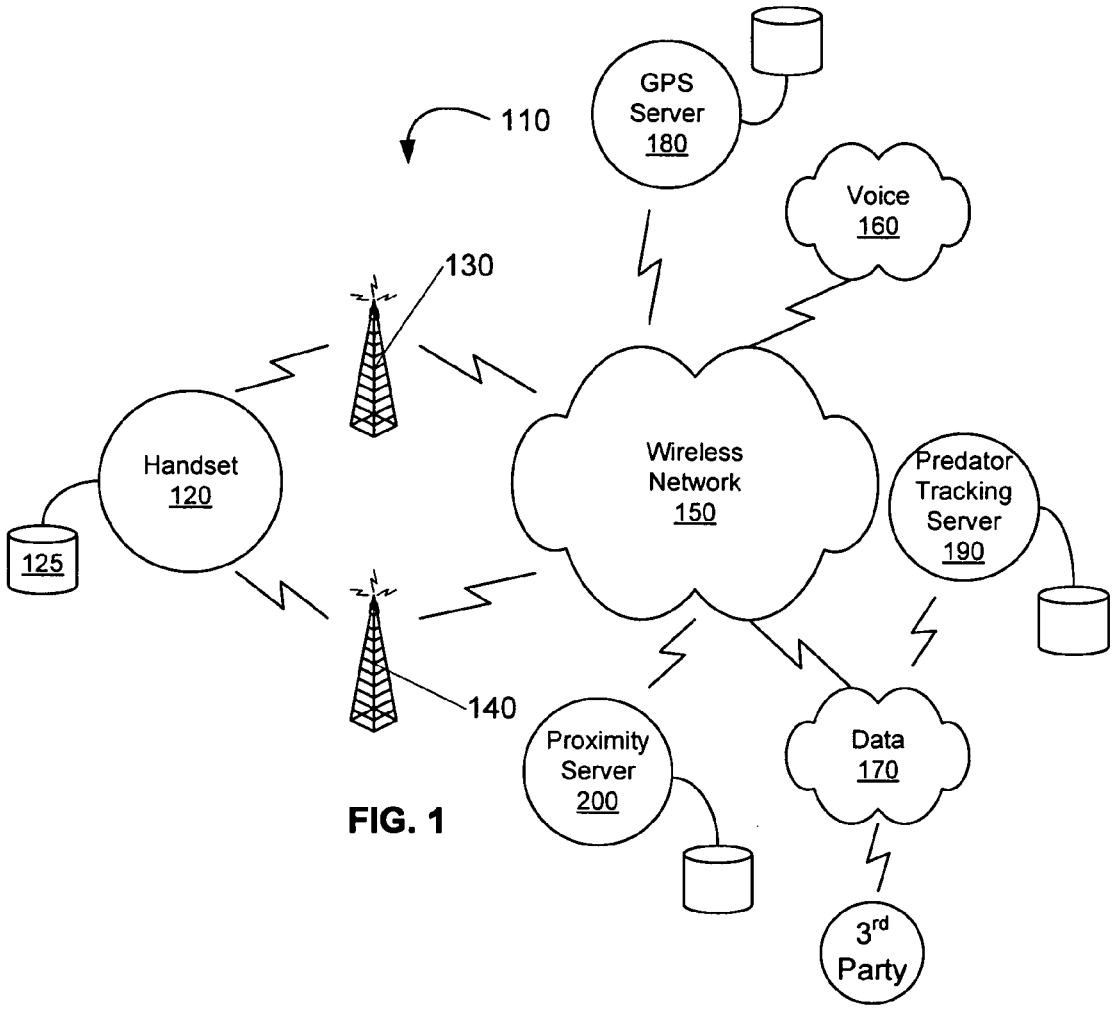
FIG. 1 is a block diagram illustrating an example system for determining whether the location of a first class of user meets certain predefined criteria when compared to the location of a second class of user, and taking appropriate action according to one embodiment.

FIG. 1 is a block diagram illustrating an example system 110 for determining whether the location of a first class of user meets certain predefined criteria when compared to the location of a second class of user, and taking appropriate action. In the illustrated embodiment, system 110 comprises one or more wireless communication devices (e.g., wireless handset(s)) 120, each configured with data storage area 125, multiple base stations 130, 140, wireless network 150, voice network 160, data network 170, first server 180 for tracking a first class of users (e.g., child with wireless communication device 120), second server 190 for tracking a second class of users (e.g., sex offender with GPS transponder), and proximity server 200 for determining whether the location of a first class of user meets certain predefined criteria when compared to the location of a second class of user (e.g., whether a sex offender is within a predetermined distance from a child).

Wireless communication device 120 can be any of a variety of wireless communication devices, including, but not limited to, a cell phone, a personal digital assistant ("PDA"), a personal computer ("PC"), a laptop computer, a PC card, special purpose equipment, or any combination of these and other devices capable of establishing a communication link with voice network 160 and/or data network 170 via wireless network 150. An example general purpose wireless device is later described with respect to FIG. 4. Wireless communication device 120 may be referred to herein as a handset, wireless device, mobile device, device, wireless unit, or mobile unit.

Data storage area 125 that is associated with handset 120 can be any sort of internal or external memory device and may include both persistent and volatile memories. The function of data storage area 125 is to maintain data for long term storage and also to provide efficient and fast access to instructions for applications that are executed by the respective device or module.

Base stations 130 and 140 can be any of a variety of types of access points that allow handset 120 to communicate over wireless network 150. In one embodiment, base station 130 is configured to carry voice traffic and operates at a frequency that is different from base station 140, which is configured to carry data traffic. Alternatively, each base station 130 and 140 may be configured to simultaneously carry both voice and data traffic. Additionally, each base station 130 and 140 may be operated by a different wireless network provider. The function of base stations 130, 140 is to send and receive the wireless network traffic (both voice and data) to and from handset 120 and convey that network traffic to and from voice network 160 and data network 170. In one embodiment, wireless network 150 may physically or logically be situated between base stations 130 and 140 and voice network 160 and data network 170.

Wireless network 150 may comprise a plurality of networks including private, public, circuit switched, packet switched, personal area networks ("PAN"), local area networks ("LAN"), wide area networks ("WAN"), metropolitan area networks ("MAN"), or any combination of the these. Other network types may also be included as needed to facilitate communication between handset 120 and voice network 160 and/or data network 170.

Furthermore, in alternative implementations, there may be more than just a single wireless network 150 and additional other networks, as will also be understood by those having skill in the art. For the sake of simplicity of this description, however, the embodiment described will include a single wireless network 150 that provides access for handset 120 to communicate with voice network 160 and data network 170.

Voice network 160 may be any of a variety of public switched networks, private radio networks, packet data networks or the like. Voice network traffic may be packetized such as in a voice over internet protocol ("VOIP") application or it may be carried over a circuit connection. Combinations of circuit and VOIP may also be employed between handset 120 and voice network 160. The function of voice network 160 is to support a voice connection between a user of handset 120 and one or more parties on remote devices (not shown).

Data network 170 may be any of a variety of networks such as a private, public, circuit switched, packet switched, PAN, LAN, WAN, MAN, or any combination of these such as the ubiquitous Internet. The function of data network 170 is to support data transmissions between handset 120 and one or more remote devices (not shown).

Figure 2:
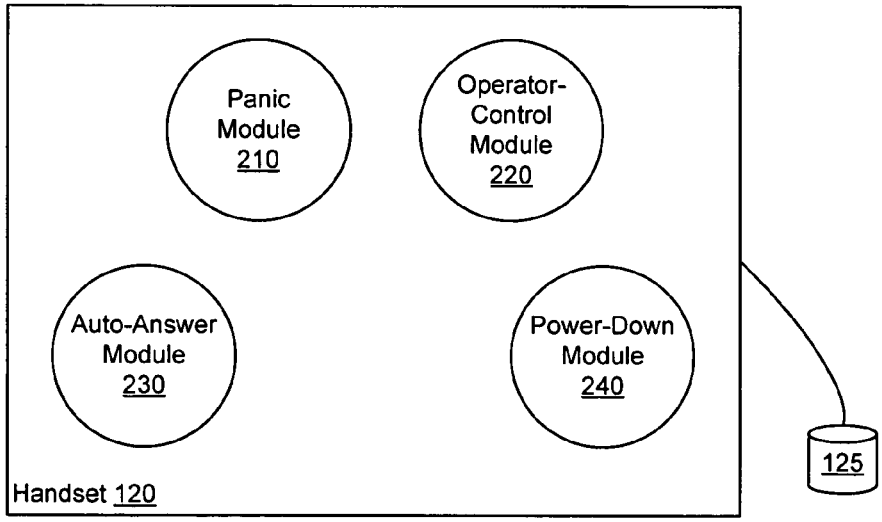
FIG. 2 is a block diagram illustrating an example wireless communication device according to one embodiment of the present invention.

FIG. 2 is a block diagram illustrating an example wireless communication device 120 according to an embodiment of the present invention. In the illustrated embodiment, handset 120 comprises panic module 210, operator control module 220, auto answer module 230, and power-down module 240. In alternative embodiments, handset 120 may include one or more of panic module 210, operator control module 220, auto answer module 230, and power-down module 240. The battery of handset 120 is integrated into the device so that it cannot be easily removed. Handset 120 is also configured with an internal or external data storage area 125 as previously described with respect to FIG. 1.

Handset 120 includes one or more input keys that when pushed actuate panic module 210. Panic module 210 is configured to put the handset in a quasi-operative mode, and connect with 911 service (and/or one or more other devices/entities, e.g., parent, guardian, school official, police officer). In the quasi-operative mode, handset 120 appears to turned off to one (e.g., sex offender) not familiar with the functions of handset 120. In the quasi-operative mode, the connection to 911 and/or other entity is maintained for as long as the operator desires. As used herein, operator refers to a remote operator or controller of handset 120 and includes, but is not limited to, a 911 operator, a telephone operator, a parent, a guardian, a school official, and a police officer.

Operator control module 220 is configured to do the following: allow the operator to maintain the call described above for as long as the operator desires, put the handset in the quasi-operative mode, allow the operator to control one or more functions on handset 120 such as, but not limited to, an emergency ringer on handset 120, control audio output level on handset 120, and listen in (through the microphone (s) on handset 120) to any voices or noises in the environment of handset 120 to help determine what is going on.

Auto-answer module 230 is configured to allow the operator to cause mobile handset 120 to automatically accept an incoming call that is not answered manually. In alternative embodiments, auto-answer module 230 routes communication back to the operator and/or establishes a three-way call with the operator so that the operator can listen in.

Power-down module 240 is configured to cause handset 120 to appear to power-down when the power-down input is pressed/activated, when, in one embodiment, only the display, lights, and any normal audio output would be turned off while handset 120 continues to operate.

Figure 3:
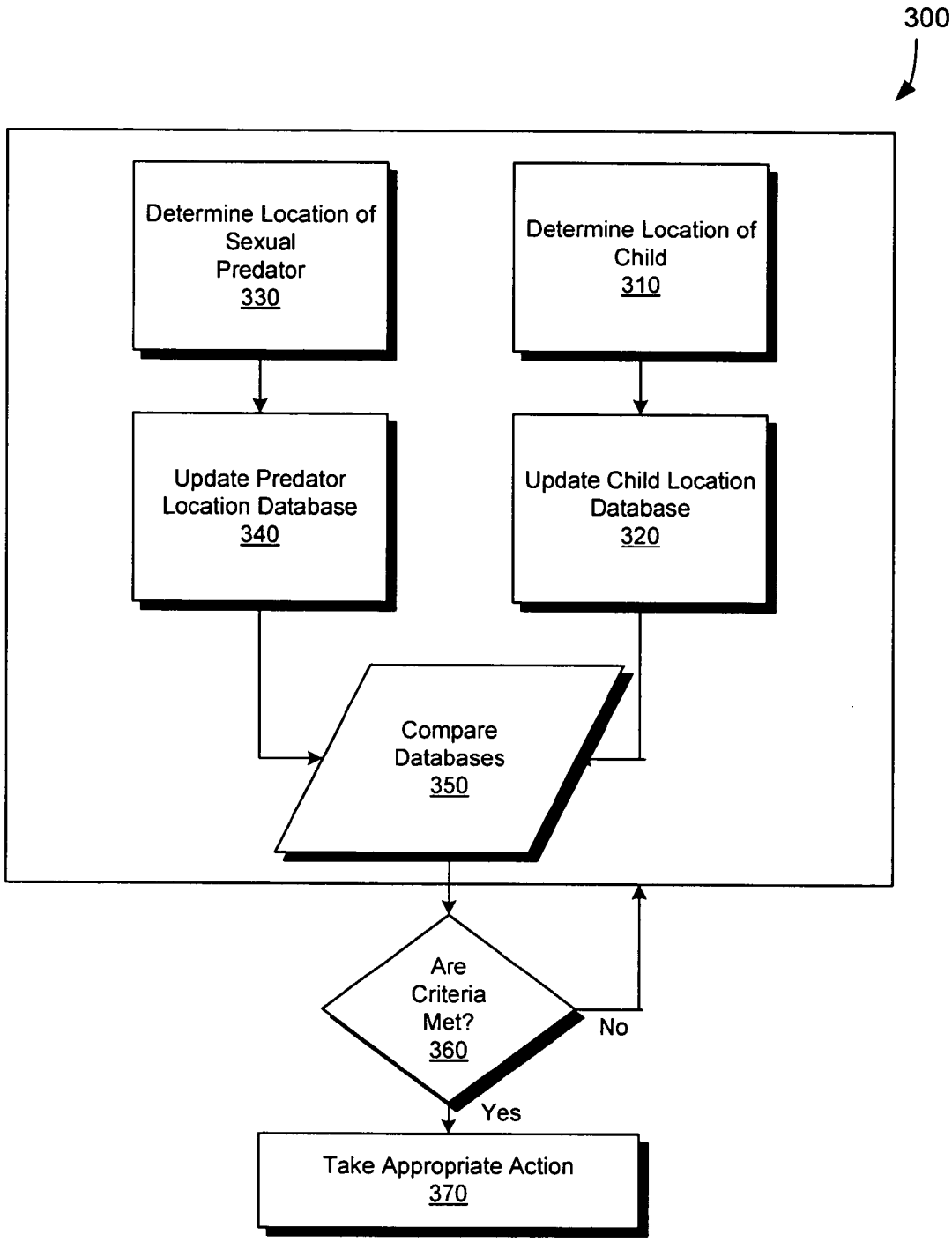
FIG. 3 is a flow diagram illustrating an example method for determining whether the location of a first class of user meets certain predefined criteria when compared to the location of a second class of user, and taking appropriate action.

FIG. 3 is a flow diagram illustrating an example method 300 for determining whether the location of a first class of user meets certain predefined criteria when compared to the location of a second class of user, and taking appropriate action according to one embodiment of the invention. In one embodiment, this method may be carried out by computer such as, but not limited to, proximity server 200. In alternative embodiments, method 300 may be carried out by one or more additional and/or different servers (and/or other computers or handsets).

Initially, at step 310, with handset 120 connected to wireless network 150, the geographic location of a first class of user (e.g., geographical location of handset 120) is determined. Because it is assumed that handset 120 is carried by an individual (e.g., child), the geographical location of handset 120 provides the geographical location of the first class of user.

At step 320, one or more location databases for tracking the location of a first class of user (e.g., child location database) are updated on the one or more first class of user tracking servers (e.g., GPS server(s)) 180.

Concurrently, at step 330, the geographic location of a second class of user (e.g., geographical location of a sex offender's location identification mechanism, e.g., GPS transponder) is determined. Because it is assumed that the GPS transponder is worn/carried by the individual (e.g., sex offender), the geographical location of the GPS transponder provides the geographical location of the second class of user.

At step 340, one or more location databases for tracking the location of a second class of user (e.g., sex offender location database) are updated on the one or more second class of user tracking servers (e.g., sex offender tracking server(s)) 190.

At step 350, data representative of the location of the first class of user and data representative of the location of the second class of user are compared.

At 360, a determination is made as to whether predetermine criteria have been met with respect to the data (e.g., does the data indicate that a sex offender is within a predetermined distance of a child). Although not shown, in additional embodiments, at one or more additional steps or sub-steps, if it is determined that a first predetermined criteria has been met, one or more further determinations for whether one or more additional criteria is met are made.

If the predetermined criteria is met, at step 370, appropriate action is taken. For example, but not by way of limitation, the action may be the placing of a communication/alert to one or more entities (e.g., police, 911 operator, a third party (parent, guardian, school official)). Other additional/alternative actions include, but not by way of limitation, an emergency ringer on handset 120 is initiated, and a quasi-operative mode is activated on handset 120 where handset 120 appears to turned off to the user, can not be controlled by the user, but connection to a 911 operator, police, third party, etc. is maintained.

If the predetermined criteria are not met, control passes on to steps 310-350, which run continuously.

The following are exemplary scenarios involving the systems and methods for determining whether the location of a first class of user meets certain predefined criteria when compared to the location of a second class of user, and taking appropriate action:

Scenario 1:

In this scenario, a child is an operator of handset 120 that is registered with a third party, e.g. law enforcement, so that the third party knows the user is a child and that the parents/guardian would like to have the child tracked. A known sex offender wearing a GPS tracking device comes into proximity of the child. As used herein, a sex offender includes anyone required to wear a location identification mechanism, e.g., GPS transponder, and have the person's location tracked as a result of a sex-related act. A known sex offender coming into proximity of the child is recognized by an interaction of the two tracking databases (See steps 350, 360 above) on the servers 180, 190. An alert (see step 370) is issued that the sex offender is within a certain distance of the child and should be monitored. If the known sex offender and the child move away from each other, no further action would be taken. If it is determined that they are on public transportation like a bus, the situation may be monitored after one or both leaves the bus. Action might be taken if the locations are extremely close and the direction of travel is the same and at the same speed.

Scenario 2:

In this scenario, which is a continuation of scenario 1, if it is determined that the child is likely with the sex offender, a third party, in this example a law enforcement officer, might choose to take actions based on knowledge of the sex offender. The officer might choose to activate auto answer module 230 on the child's handset 120 to listen and determine what is happening. By activating operator-control module 220 of handset 120, the officer might cause handset 120 to ring very loudly to distract the sex offender. In addition, the officer may dispatch officers to that location to apprehend the sex offender.

With power-down module 240 on handset 120, handset 120 only appears to power down when the power-down procedure is performed (the display, lights, and any audio output would be turned off, but handset 120 would continue to operate). If 911 is called by handset 120, handset 120 appears to be off while the 911 operator is still able to hear. Using operator-control module 220, the operator can control the audio output of the handset and other functions. The child may also actuate panic module 210 on handset 120 to put handset 120 in a quasi-operative mode, and connect with 911 service (and/or one or more other devices/entities, e.g., parent, guardian, police officer).

Scenario 3:

In this scenario, a teenager may be a user of handset 120 that is registered as described in scenario 1. The teenager is out with friends. That evening there has been some gang related incidents in a particular part of town. This information is noted in a database on server 190. As the teen approaches this area, an SMS message (and/or other communication) is sent from the server 200 (or a related/different server) warning of the activity in that area and suggesting a different route. In addition, the parents (e.g., third party) may also receive a message with similar information that in turn could prompt them to call their teenager.

Scenario 4:

In this scenario, which is a commercial application of the systems and methods for determining whether the location of a first class of user meets certain predefined criteria when compared to the location of a second class of user, and taking appropriate action, would be a driving assistance service to avoid traffic delays. In some locations, the state and/or local transportation agency make available information about the current traffic conditions on their roadways. Speed is a primary indicator. This information is provided by sensors located in, on, or near the roadway. It is also possible that if there are enough subscribers to the driving assistance service, their location and speed might also be used instead of or to augment the information available. Traffic information might come from other sources that are continually updated. As a driver approaches an area of high traffic, as observed by the service provider, the driver is issued a warning and a suggested alternative route if one is available. In some cases, there will be no additional route.

In the above scenarios, the data corresponding to changing location/conditions for both the first class of users and the second class of users/information is dynamic. In further embodiments, the data corresponding to the either the first class of users or the second class of users/information may be static. For example, but not by way of limitation, another scenario/implementation may include monitoring the dynamic location of shipping vehicles (e.g., commercial shipping planes, trains, trucks, boats) with respect to static delivery locations, and taking appropriate action (e.g., sending notification alerts to receiver, shipper) when certain predefined criteria is met.

Figure 4:
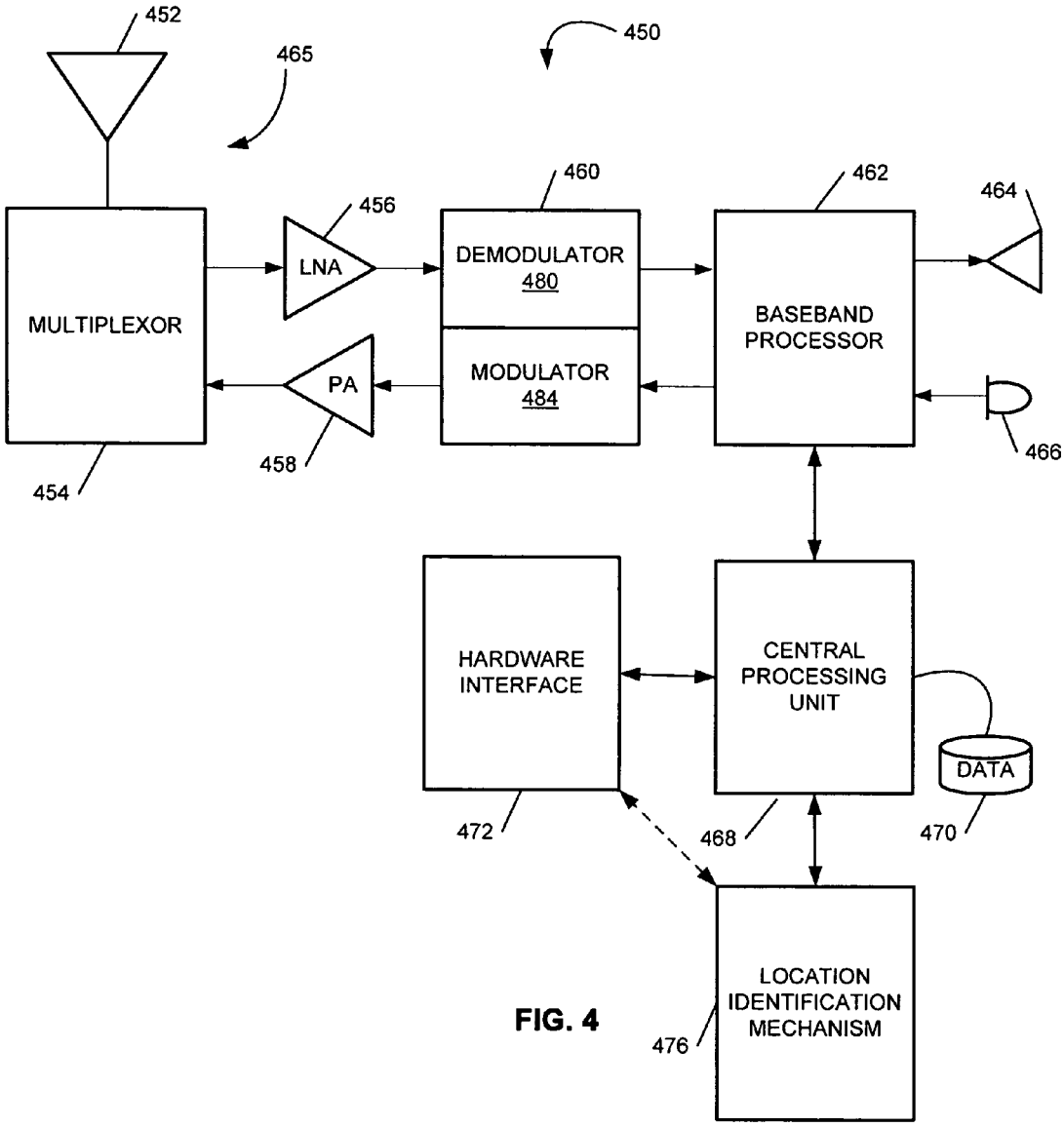
FIG. 4 is a block diagram illustrating an exemplary wireless communication device that may be used in connection with the various embodiments described herein.

FIG. 4 is a block diagram illustrating an exemplary wireless communication device 450 that may be used in connection with the various embodiments described herein. For example, wireless communication device 450 may be used in conjunction with handset 120 described above with respect to FIGS. 1 and 2. However, other wireless communication devices and/or architectures may also be used, as will be clear to those skilled in the art.

In the illustrated embodiment, wireless communication device 450 comprises antenna system 455, radio system 460, baseband system 462, speaker 464, microphone 456, central processing unit ("CPU") 468, data storage area 466, hardware interface 472, and location identification mechanism 476. In wireless communication device 450, radio frequency ("RF") signals are transmitted and received over the air by antenna system 455 under the management of radio system 460.

In one embodiment, antenna system 455 may comprise one or more antennae 452 and one or more multiplexors 454 that perform a switching function to provide antenna system 455 with transmit and receive signal paths. In the receive path, received RF signals can be coupled from a multiplexor to a low noise amplifier 456 that amplifies the received RF signal and sends the amplified signal to radio system 460.

In alternative embodiments, radio system 460 may comprise one or more radios that are configured to communication over various frequencies. In one embodiment, radio system 460 may combine demodulator 480 and modulator 484 in one integrated circuit ("IC"). The demodulator and modulator can also be separate components. In the incoming path, the demodulator strips away the RF carrier signal leaving a baseband receive audio signal, which is sent from radio system 460 to baseband system 462.

If the received signal contains audio information, then baseband system 462 decodes the signal and converts it to an analog signal. Then the signal is amplified and sent to the speaker 466. Baseband system 462 also receives analog audio signals from microphone 480. These analog audio signals are converted to digital signals and encoded by baseband system 462. Baseband system 462 also codes the digital signals for transmission and generates a baseband transmit audio signal that is routed to the modulator portion of radio system 460. The modulator mixes the baseband transmit audio signal with an RF carrier signal generating an RF transmit signal that is routed to the antenna system and may pass through power amplifier 458. The power amplifier 458 amplifies the RF transmit signal and routes it to antenna system 455 where the signal is switched to the antenna port for transmission.

Baseband system 462 is also communicatively coupled with the central processing unit 468. Central processing unit 468 has access to a data storage area 470. Central processing unit 468 is preferably configured to execute instructions (i.e., computer programs or software) that can be stored in data storage area 470. Computer programs can also be received from baseband processor 462 and stored in data storage area 470 or executed upon receipt. Such computer programs, when executed, enable wireless communication device 450 to perform the various functions of the present invention as previously described. For example, data storage area 470 may include modules 210, 220, 230, 240 that were previously described with respect to FIG. 2.

In this description, the term "computer readable medium" is used to refer to any media used to provide executable instructions (e.g., software and computer programs) to wireless communication device 450 for execution by the central processing unit 468. Examples of these media include data storage area 470, microphone 466 (via baseband system 462), antenna system 455 (also via baseband system 462), and hardware interface 472. These computer readable mediums are means for providing executable code, programming instructions, and software to wireless communication device 450. The executable code, programming instructions, and software, when executed by the central processing unit 468, preferably cause central processing unit 468 to perform the inventive features and functions previously described herein.

Central processing unit 468 is also preferably configured to receive notifications from hardware interface 472 when new devices are detected by the hardware interface. Hardware interface 472 can be a combination electromechanical detector with controlling software that communicates with the CPU 468 and interacts with new devices. Hardware interface 472 may be a firewire port, a USB port, a Bluetooth or infrared wireless unit, or any of a variety of wired or wireless access mechanisms. Examples of hardware that may be linked with device 450 include data storage devices, computing devices, headphones, microphones, location identification mechanism 476 and the like.

Location identification mechanism 476 may be any combination of hardware and software for providing/reporting the position of wireless communication device 120. For example, but not by way of limitation, the location identification mechanism 476 may be a GPS (or A-GPS and AFLT) receiver with appropriate hardware/software. The measurements used to determine position may be done at wireless communication device 120 and/or by the network.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. In addition, the grouping of functions within a module, block, circuit or step is for ease of description. Specific functions or steps can be moved from one module, block or circuit to another without departing from the invention.

Various embodiments may also be implemented primarily in hardware using, for example, components such as application specific integrated circuits ("ASICs", or field programmable gate arrays ("FPGAs"). Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. For example, implementation of a hardware state machine capable of performing the functions described herein will also be apparent to those skilled in the relevant art. Various embodiments may also be implemented using a combination of both hardware and software.

Moreover, the various illustrative logical blocks, modules, and methods described in connection with the embodiments disclosed herein can be implemented or performed with a general purpose processor, a digital signal processor, ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

Figure 5:
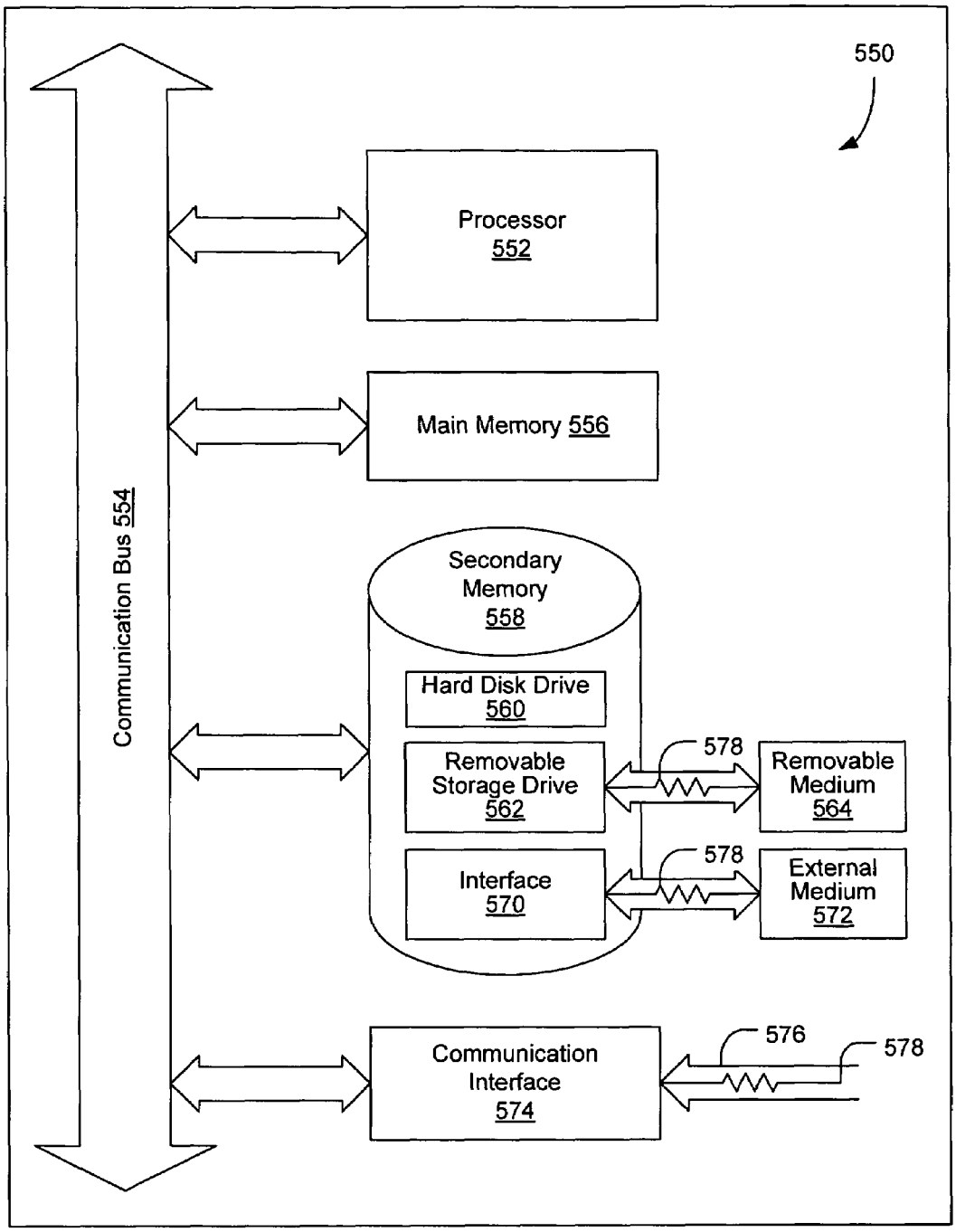
FIG. 5 is a block diagram illustrating an exemplary computer system that may be used in connection with the various embodiments described herein.

FIG. 5 is a block diagram illustrating an exemplary computer system 550 that may be used in connection with the various embodiments described herein. For example, computer system 550 (or various components or combinations of components of computer system 550) may be used in conjunction with one or more of servers 180, 190, 200 as previously described. However, other computer systems and/or architectures may be used, as will be clear to those skilled in the art.

Computer system 550 preferably includes one or more processors, such as processor 552. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with processor 552.

Processor 552 is preferably connected to communication bus 554. Communication bus 554 may include a data channel for facilitating information transfer between storage and other peripheral components of computer system 550. Communication bus 554 further may provide a set of signals used for communication with processor 552, including a data bus, address bus, and control bus (not shown). Communication bus 554 may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or standards promulgated by the Institute of Electrical and Electronics Engineers ("IEEE") including IEEE 488 general-purpose interface bus ("GPIB"), IEEE 696/S-100, and the like.

Computer system 550 preferably includes main memory 556 and may also include secondary memory 558. Main memory 556 provides storage of instructions and data for programs executing on processor 552. Main memory 556 is typically semiconductor-based memory such as dynamic random access memory ("DRAM") and/or static random access memory ("SRAM"). Other semiconductor-based memory types include, for example, synchronous dynamic random access memory ("SDRAM"), Rambus dynamic random access memory ("RDRAM"), ferroelectric random access memory ("FRAM"), and the like, including read only memory ("ROM").

Secondary memory 558 may optionally include hard disk drive 560 and/or removable storage drive 562, for example a floppy disk drive, a magnetic tape drive, a compact disc ("CD") drive, a digital versatile disc ("DVD") drive, etc. The removable storage drive 562 reads from and/or writes to removable storage medium 564. Removable storage medium 564 may be, for example, a floppy disk, magnetic tape, CD, DVD, etc.

Removable storage medium 564 is preferably a computer readable medium having stored thereon computer executable code (i.e., software) and/or data. The computer software or data stored on the removable storage medium 564 is read into computer system 550 as electrical communication signals 578.

In alternative embodiments, secondary memory 558 may include other similar means for allowing computer programs or other data or instructions to be loaded into computer system 550. Such means may include, for example, external storage medium 572 and interface 570. Examples of external storage medium 572 may include an external hard disk drive or an external optical drive, or and external magneto-optical drive.

Other examples of secondary memory 558 may include semiconductor-based memory such as programmable read-only memory ("PROM"), erasable programmable read-only memory ("EPROM"), electrically erasable read-only memory ("EEPROM"), or flash memory (block oriented memory similar to EEPROM). Also included are any other removable storage units 572 and interfaces 570, which allow software and data to be transferred from the removable storage unit 572 to computer system 550.

Computer system 550 may also include communication interface 574. Communication interface 574 allows software and data to be transferred between computer system 550 and external devices (e.g. printers), networks, or information sources. For example, computer software or executable code may be transferred to computer system 550 from a network server via communication interface 574. Examples of communication interface 574 include a modem, a network interface card ("NIC"), a communications port, a PCMCIA slot and card, an infrared interface, and an IEEE 1394 fire-wire, just to name a few.

Communication interface 574 preferably implements industry promulgated protocol standards, such as Ethernet IEEE 802 standards, Fiber Channel, digital subscriber line ("DSL"), asynchronous digital subscriber line ("ADSL"), frame relay, asynchronous transfer mode ("ATM"), integrated digital services network ("ISDN"), personal communications services ("PCS"), transmission control protocol/Internet protocol ("TCP/IP"), serial line Internet protocol/point to point protocol ("SLIP/PPP"), and so on, but may also implement customized or non-standard interface protocols as well.

Software and data transferred via communication interface 574 are generally in the form of electrical communication signals 578. These signals 578 are preferably provided to communication interface 574 via communication channel 576. Communication channel 576 carries signals 578 and can be implemented using a variety of wired or wireless communication means including wire or cable, fiber optics, conventional phone line, cellular phone link, wireless data communication link, radio frequency (RF) link, or infrared link, just to name a few.

Computer executable code (i.e., computer programs or software) is stored in main memory 556 and/or secondary memory 558. Computer programs can also be received via communication interface 574 and stored in main memory 556 and/or secondary memory 558. Such computer programs, when executed, enable computer system 550 to perform the various functions of the present invention as previously described.

In this description, the term "computer readable medium" is used to refer to any media used to provide computer executable code (e.g., software and computer programs) to computer system 550. Examples of these media include main memory 556, secondary memory 558 (including hard disk drive 560, removable storage medium 564, and external storage medium 572), and any peripheral device communicatively coupled with communication interface 574 (including a network information server or other network device). These computer readable mediums are means for providing executable code, programming instructions, and software to computer system 550.

In an embodiment that is implemented using software, the software may be stored on a computer readable medium and loaded into computer system 550 by way of removable storage drive 562, interface 570, or communication interface 574. In such an embodiment, the software is loaded into computer system 550 in the form of electrical communication signals 578. The software, when executed by processor 552, preferably causes processor 552 to perform the inventive features and functions previously described herein.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A method for tracking the location of a first class of user and a second class of user, comprising:

providing a wireless communication device for the first class of user, the wireless communication device including an antenna system configured to send and receive signals over a wireless physical medium; a radio system configured to manage the antenna system for use with a radio access technology to provide connection to the wireless network; a location identification mechanism for obtaining and providing location information on the wireless communication device; a central processing unit configured to execute instructions stored in a data storage area and access data stored in a data storage area; a panic module executable by the central processing unit, the panic module configured to put the wireless communication device in a quasi-operative mode that appears to be off to the user and to place a communication to a remote operator, and to maintain the connection with the remote operator as long as the remote operator desires; remote operator-control module executable by the central processing unit, the remote operator-control module configured to allow the remote operator to maintain control of the communication with the wireless communication device and to allow the remote operator to remotely control one or more functions of an emergency ringer and audio output level on the wireless communication device; an auto-answer module executable by the central processing unit, the auto-answer module configured to automatically establish a connection with the wireless communication device from an incoming call that is not answered manually; a power-down module executable by the central processing unit, the power-down module configured to cause the handset to appear to power-down upon actuation of a power-down sequence while continuing to maintain a connection between the wireless communication device and the remote operator;

determining a location of a first class of user via the location identification mechanism of the wireless communication device;

updating a first class of user location database with the location of the first class of user;

determining a location of a second class of user;

updating a second class of user location database with the location of the second class of user;

comparing location of the first class of user with the location of the second class of user;

determining whether predetermined criteria related to the location of the first class of user with the location of the second class of user is met;

initiating a communication to one or more entities if the predetermined criteria is met.

2. The method of claim 1, wherein the first class of user is a child and the wireless communication device is a handset, the second class of user is a sex offender with a GPS transponder, determining a location of a first class of user includes determining the location of the child by determining the location of the handset via the location identification mechanism, and determining a location of a second class of user includes determining the location of the sex offender by determining the location of the GPS transponder.

3. The method of claim 2, wherein determining whether predetermined criteria related to the location of the first class of user with the location of the second class of user is met includes determining whether the sex offender is within a predetermined distance of the child.

4. The method of claim 3, wherein initiating a communication to one or more entities includes initiating a communication to at least one of a 911 operator, a telephone operator, police, a parent, a guardian, and a school official.

5. A system for tracking the location of a first class of user and a second class of user, comprising:

a wireless communication device carried by the first class of user, the wireless communication device including an antenna system configured to send and receive signals over a wireless physical medium; a radio system configured to manage the antenna system for use with a radio access technology to provide connection to the wireless network; a location identification mechanism for obtaining and providing location information on the wireless communication device; a central processing unit configured to execute instructions stored in a data storage area and access data stored in a data storage area; a panic module executable by the central processing unit, the panic module configured to put the wireless communication device in a quasi-operative mode that appears to be off to the user and to place a communication to a remote operator, and to maintain the connection with the remote operator as long as the remote operator desires; remote operator-control module executable by the central processing unit, the remote operator-control module configured to allow the remote operator to maintain control of the communication with the wireless communication device and to allow the remote operator to remotely control one or more functions of an emergency ringer and audio output level on the wireless communication device; an auto-answer module executable by the central processing unit, the auto-answer module configured to automatically establish a connection with the wireless communication device from an incoming call that is not answered manually; a power-down module executable by the central processing unit, the power-down module configured to cause the handset to appear to power-down upon actuation of a power-down sequence while continuing to maintain a connection between the wireless communication device and the remote operator;

a location identification mechanism carried by the second class of user;

one or more servers including one or more modules configured to:

determine a location of a first class of user;

update a first class of user location database with the location of the first class of user;

determine a location of a second class of user;

update a second class of user location database with the location of the second class of user;

compare location of the first class of user with the location of the second class of user;

determine whether predetermined criteria related to the location of the first class of user with the location of the second class of user is met;

initiate a communication to one or more entities if the predetermined criteria is met.

6. The system of claim 5, wherein the first class of user is a child and the wireless communication device is a handset with the location identification mechanism, the second class of user is a sex offender and the location identification mechanism is a GPS transponder, and the one or more modules determine the location of the child by determining the location of the handset, and determine the location of the sex offender by determining the location of the GPS transponder.

7. The system of claim 6, wherein the one or more modules determine whether the sex offender is within a predetermined distance of the child.

8. The system of claim 7, wherein the one or more modules initiate a communication to at least one of a 911 operator, a telephone operator, police, a parent, a guardian, and a school official.

9. A wireless communication device configured to be communicatively coupled to a wireless network, the wireless communication device comprising:

an antenna system configured to send and receive signals over a wireless physical medium;

a radio system configured to manage the antenna system for use with a radio access technology to provide connection to the wireless network;

a location identification mechanism for obtaining and providing location information on the wireless communication device;

a central processing unit configured to execute instructions stored in a data storage area and access data stored in a data storage area;

a panic module executable by the central processing unit, the panic module configured to put the wireless communication device in a quasi-operative mode that appears to be off to the user and to place a communication to a remote operator, and to maintain the connection with the remote operator as long as the remote operator desires;

a remote operator-control module executable by the central processing unit, the remote operator-control module configured to allow the remote operator to maintain control of the communication with the wireless communication device and to allow the remote operator to remotely control one or more functions of an emergency ringer and audio output level on the wireless communication device;

an auto-answer module executable by the central processing unit, the auto-answer module configured to automatically establish a connection with the wireless communication device from an incoming call that is not answered manually;

a power-down module executable by the central processing unit, the power-down module configured to cause the handset to appear to power-down upon actuation of a power-down sequence while continuing to maintain a connection between the wireless communication device and the remote operator.

10. The wireless communication device of claim 9, wherein the wireless communication device is one or more of a cell phone, a personal digital assistant, a personal computer, a laptop computer, a PC card, and special purpose equipment.

11. The wireless communication device of claim 9, wherein the wireless communication device includes a battery to power the wireless communication device, and the battery is integrated into the wireless communication device and not easily removable.

12. The wireless communication device of claim 9, wherein the remote operator is a member from the group consisting of a 911 operator, a telephone operator, a parent, a guardian, a school official, and a police officer.

13. The wireless communication device of claim 9, wherein the auto-answer module is configured to establish a three-way call with the wireless communication device, another entity, and the remote operator.

14. The wireless communication device of claim 9, wherein the wireless communication device includes a display, lights, and audio output, and the power-down module is configured to cause the display, lights, and audio output to be turned off while the wireless communication device continues to operate.

15. The wireless communication device of claim 9, wherein the remote operator-control module is configured so that the emergency ringer on the wireless communication device is remotely actuatable by the remote operator to ring loudly to distract someone in the area of the wireless communication device.

* * * * *